US009896923B2

(12) United States Patent
Lakhtychkin et al.

(10) Patent No.: US 9,896,923 B2
(45) Date of Patent: Feb. 20, 2018

(54) SYNCHRONIZING PULSES IN HETEROGENEOUS FRACTURING PLACEMENT

(71) Applicant: SCHLUMBERGER TECHNOLOGY CORPORATION, Sugar Land, TX (US)

(72) Inventors: Aleksandr Lakhtychkin, Calgary (CA); Mikhail Shestakov, Red Deer (CA); Chad Kraemer, Katy, TX (US); Herbe Gomez Conzatti y Martinez, Houston, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 14/287,526

(22) Filed: May 27, 2014

(65) Prior Publication Data

US 2014/0352954 A1 Dec. 4, 2014

Related U.S. Application Data

(60) Provisional application No. 61/827,866, filed on May 28, 2013.

(51) Int. Cl.
*C09K 8/80* (2006.01)
*E21B 43/267* (2006.01)

(52) U.S. Cl.
CPC ..... *E21B 43/267* (2013.01)

(58) Field of Classification Search
CPC ..... E21B 45/00; E21B 49/087; C09K 8/80
(Continued)

(56) References Cited

U.S. PATENT DOCUMENTS 36,577 A 9/1862 Scott
48,554 A 7/1865 Harris
(Continued)

FOREIGN PATENT DOCUMENTS

CN 202926404 U 5/2013
RU 2064575 C1 7/1996
(Continued)

OTHER PUBLICATIONS

Office Action issued in Chinese Patent Appl. No. 201480029778.3 dated Mar. 3, 2017; 12 pages.
(Continued)

*Primary Examiner* — Doug Hutton, Jr.
*Assistant Examiner* — Ashish Varma
(74) *Attorney, Agent, or Firm* — Andrea E. Tran

(57) ABSTRACT

A technique facilitates a fracturing operation by maintaining the heterogeneity of proppant fluid as it is injected into reservoir fractures. The technique comprises using a blender to deliver proppant material in a pulsating manner to create pulses of proppant. The pulses of proppant are mixed with a fluid to create a proppant slurry having the pulses of proppant material separated by a second fluid. The proppant slurry is then split between a plurality of pumps which are operated to pump the slurry to a well. To maintain heterogeneity, the pump rates of the pumps are individually adjusted to control dispersion of the pulses of proppant downstream of the pumps and to substantially maintain the separated pulses of proppant material in the slurry. A wide variety of other system adjustments also may be made for enhancing the ability of the overall fracturing system to maintain separated pulses of concentrated proppant material.

9 Claims, 7 Drawing Sheets

(58) Field of Classification Search
USPC ..... 166/250.15
See application file for complete search history.

(56) References Cited

U.S. PATENT DOCUMENTS

| | | | | |
|---|---|---|---|---|
| 5,799,734 | A | 9/1998 | Norman et al. | |
| 6,776,235 | B1 | 8/2004 | England | |
| 7,451,812 | B2 | 11/2008 | Cooper et al. | |
| 7,581,590 | B2 | 9/2009 | Lesko et al. | |
| 7,798,224 | B2 | 9/2010 | Huang et al. | |
| 8,066,068 | B2 | 11/2011 | Lesko et al. | |
| 8,141,637 | B2 | 3/2012 | Barmatov et al. | |
| 8,812,334 | B2 | 8/2014 | Givens et al. | |
| 2003/0161212 | A1 | 8/2003 | Neal et al. | |
| 2008/0149329 | A1* | 6/2008 | Cooper | E21B 43/267 166/250.01 |
| 2011/0036577 | A1 | 2/2011 | Barmatov et al. | |
| 2011/0083849 | A1 | 4/2011 | Medvedev et al. | |
| 2011/0114313 | A1* | 5/2011 | Lesko | C09K 8/665 166/280.1 |
| 2011/0202275 | A1* | 8/2011 | Beisel | E21B 47/06 702/6 |
| 2011/0240293 | A1 | 10/2011 | Lesko et al. | |
| 2012/0006550 | A1 | 1/2012 | Shampine et al. | |
| 2012/0048554 | A1 | 3/2012 | Hughes et al. | |
| 2012/0325472 | A1 | 12/2012 | Litvinets et al. | |
| 2013/0105166 | A1 | 5/2013 | Medvedev et al. | |
| 2013/0146292 | A1 | 6/2013 | Litvinets et al. | |

FOREIGN PATENT DOCUMENTS

| | | | |
|---|---|---|---|
| RU | 2253856 | C1 | 6/2005 |
| RU | 2460876 | C1 | 9/2012 |
| WO | 2007086771 | A1 | 8/2007 |
| WO | 2007097658 | A1 | 8/2007 |
| WO | 2008143544 | A1 | 11/2008 |
| WO | 2008147241 | A1 | 12/2008 |
| WO | 2009093927 | A1 | 7/2009 |
| WO | 2009096805 | A1 | 8/2009 |
| WO | 2009123491 | A1 | 10/2009 |
| WO | 2009126057 | A1 | 10/2009 |
| WO | 2010071994 | A1 | 7/2010 |
| WO | 2011081546 | A1 | 7/2011 |
| WO | 2011081549 | A1 | 7/2011 |
| WO | 2011136678 | A1 | 11/2011 |
| WO | 2011145965 | A1 | 11/2011 |
| WO | 2012166590 | A1 | 12/2012 |
| WO | 2013055851 | A2 | 4/2013 |
| WO | 2013095173 | A1 | 6/2013 |

OTHER PUBLICATIONS

Examination Report issued in Australian Patent Appl. No. 2014274295 dated Jun. 9, 2017; 2 pages.

Decision on Grant issued in Russian Patent Appl. No. 2015150727 dated Aug. 21, 2017; 12 pages (with English translation).

* cited by examiner

SYNCHRONIZING PULSES IN HETEROGENEOUS FRACTURING PLACEMENT

PRIORITY

This application claims priority as a nonprovisional patent application of U.S. Provisional Patent Application Ser. No. 61/827,866 filed May 28, 2013 with the same title which is incorporated by reference herein.

BACKGROUND

Hydraulic fracturing improves well productivity by creating high-permeability flow passages extending through a reservoir to a wellbore. Hydraulic fracturing includes hydraulically injecting a fracturing fluid, e.g. fracturing slurry, into a wellbore that penetrates a subterranean formation. The fracturing fluid is directed against the formation strata under pressure until the strata is forced to crack and fracture. Proppant is then placed in the fracture to prevent collapse of the fracture and to improve the flow of fluid, e.g. oil, gas or water, through the reservoir to the wellbore.

In many fracturing operations, proppant is delivered and mixed with a clean carrier fluid to create the proppant fluid or slurry. The slurry is then pumped by a series of pumps to a common manifold or missile and delivered to a wellhead for injection downhole under pressure. The heterogeneity of the proppant in the proppant fluid can be helpful in improving the conductivity of the fractures once the proppant is injected into the fractures. However, the use of multiple pumps and the design of the overall fracturing system can effectively mix the proppant through the clean fluid and create a substantially homogeneous slurry.

SUMMARY

In general, a technique is provided for facilitating a fracturing operation by maintaining the heterogeneity of proppant fluid as it is injected into fractures extending through the reservoir. The technique comprises using a blender to deliver proppant material in a pulsating manner to create pulses or slugs of proppant. The pulses or slugs of proppant are mixed with a fluid to create a proppant slurry in which the pulses of proppant material are separated by a second fluid having a lower concentration of proppant. The proppant slurry is then split between a plurality of pumps which are operated to pump the slurry to a well. To maintain heterogeneity, the pump rates of the pumps are individually adjusted to control dispersion of the pulses of proppant downstream of the pumps and to substantially maintain the separated pulses of proppant material and thus the heterogeneity of the proppant slurry. A wide variety of other system adjustments also may be made for enhancing the ability of the overall fracturing system to maintain the separated pulses or slugs of concentrated proppant material.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The present disclosure generally relates to a technique for facilitating a fracturing operation by maintaining the heterogeneity of proppant fluid as it is injected into fractures extending through a reservoir. A blender may be used to deliver proppant material in a pulsating manner to create pulses or slugs of proppant. In this example, the proppant is mixed with a fluid with no proppant and delivered to a missile manifold as a proppant slurry. The proppant slurry is then split between a plurality of pumps which are operated to pump the portions of the proppant slurry to a well. After passing through the plurality of pumps, the portions of the proppant slurry are recombined into a single mixture which may be delivered to a wellhead. To maintain heterogeneity, the pump rates of the pumps are individually adjusted to control dispersion of the pulses of proppant downstream of the pumps and to substantially maintain the separated pulses of proppant material and thus the heterogeneity of the proppant slurry. Other system adjustments also may be made for enhancing the ability of the overall fracturing system to maintain the separated pulses or slugs of concentrated proppant material after the portions of the proppant pulses are passed through the pumps and recombined.

Figure 1:
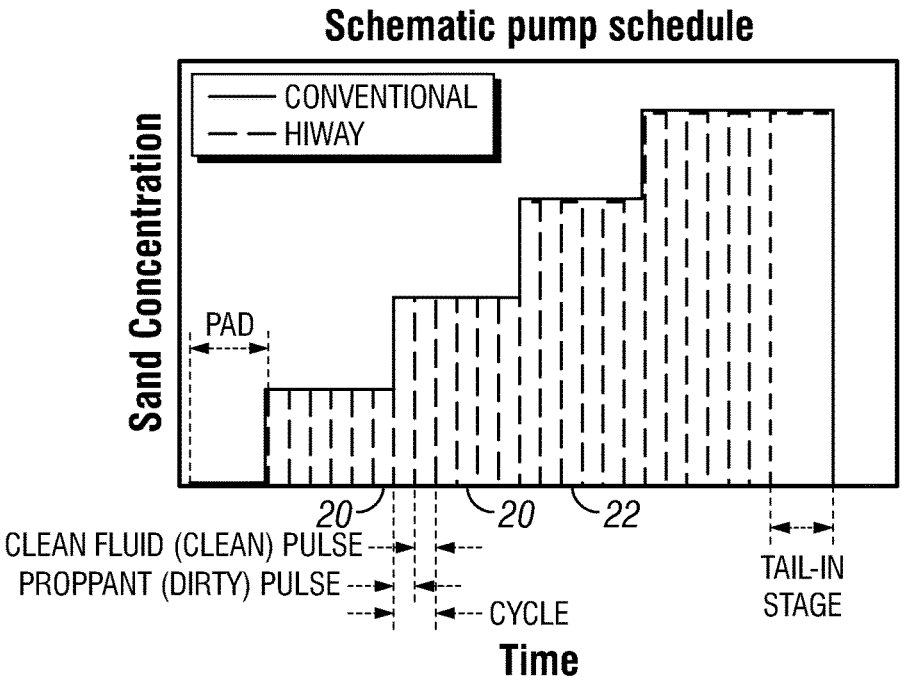
FIG. 1 is a graphical illustration of a pump schedule for pumping a slurry having pulses of proppant received from a blender, according to an embodiment of the disclosure.

In FIG. 1, a graph is provided and illustrates the pulses of proppant delivered from the blender to the pumps. In a heterogeneous proppant placement application, the blender may be designed to release proppant, e.g. sand, in a pulsating manner. The pulses of proppant are combined with less proppant fluid pulses such that relatively low proppant concentration fluid pulses 20 are followed by relatively high proppant concentration pulses 22, as illustrated in FIG. 1.

Figure 2:
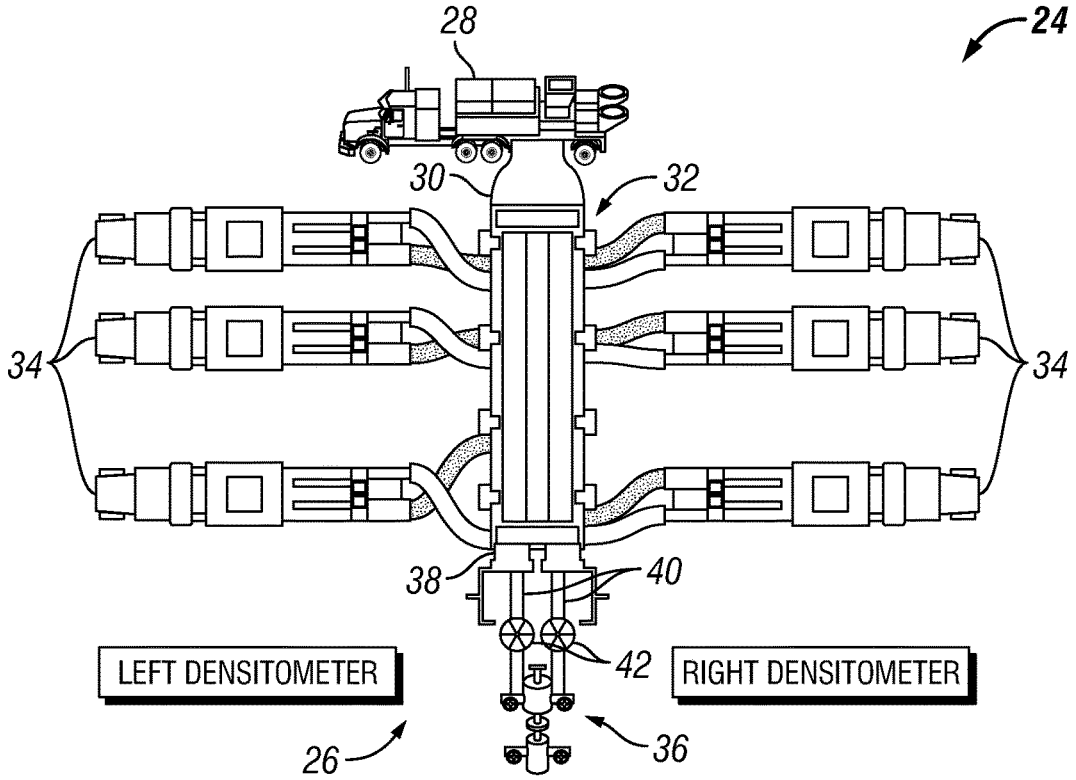
FIG. 2 is a schematic illustration of a fracturing system deployed at a well site, according to an embodiment of the disclosure.

In FIG. 2, an example of a fracturing system 24 is illustrated as deployed at a well site 26. It should be noted that fracturing system 24 may comprise a wide variety of other and/or additional components depending on the circumstances including the formation and the design of a given fracturing operation. In the example illustrated, fracturing system 24 comprises a blender 28 which blends proppant and fluid, e.g. clean fluid, to create a fracturing fluid or slurry which is delivered into a manifold 30 of a missile 32. As described above, the blender 28 may be designed to release the proppant in a pulsating manner to create pulses of proppant separated by pulses of clean fluid having a lower concentration of proppant, as illustrated graphically in FIG. 1.

Once a pulse of proppant enters the missile manifold 30, the pulse is split between a plurality of pumps 34. The plurality of pumps 34 is divided into left side pumps and right side pumps, and the portions of the pulses or slugs of proppant 22 travel through the plurality of pumps 34. Due to a variety of fracturing system factors, the portions of proppant pulses 22 may exit the manifold 30 at different times which tends to mix the proppant pulses 22 with the clean fluid pulses 20. For example, due to differences between suction and discharge line diameters of manifold 30, differences between the way pumps 34 are rigged up, differences in pump rates, and other component differences, the portions of the same proppant pulse 22 can exit the manifold 30 at different times unless manipulated as described in greater detail below. Thus, the initial slug or pulse of concentrated proppant material is not reconstructed at a wellhead 36 and instead of a single highly concentrated pulse of proppant, the pulse becomes dispersed. Injection of this more dispersed proppant slurry into reservoir fractures results in narrower channels as compared to injection of more heterogeneous proppant slurry.

In contrast to the dispersion described above, the present design manipulates parameters of the fracturing system 24 to maintain heterogeneity by causing the portions of proppant pulses 22 traveling through the different pumps to meet downstream, e.g. at wellhead 36, at the same time. In one embodiment, the pumping rates of the high-pressure equipment, e.g. pumps 34, may be manipulated to cause the proppant pulses 22 to move through the different pumps 34 so that the portions of the proppant pulses are recombined downstream of manifold 30 at the same time. A variety of control schemes may be used to adjust the pumping rates of pumps 34 to achieve the heterogeneous proppant slurry at wellhead 36. For example, a variety of spreadsheet programs, C language computer programs, processor-based calculations, and/or other calculations utilizing fluid mechanics equations may be used to determine the appropriate manipulation of pump rates. In an embodiment, pump rates are calculated for each pump 34 and those pump rates are manipulated to minimize the dispersion of the proppant pulses 22 as fracturing fluid exits manifold 30 and moves into wellhead 36 after traveling through the various high and low pressure lines.

Embodiments described herein comprise a process of adjusting pump rates on surface equipment to cause the pulses of proppant 22 to reach the wellhead 36 at the same time or approximately the same time. This reduces pulse dispersion and increases the effectiveness of the fracturing treatment. The adjustment of pumping rates may be evaluated and selected according to desired control parameters based on, for example, output from spreadsheets, executable computer programs, other processor-based calculations, and/or other types of calculations to determine the flow of particles and thus the flow of portions of the proppant pulses 22 through each of the pumps 34 before reaching the wellhead 36. The pumping rates may be adjusted automatically by a computer-based control system and/or with input from a field operator.

In the embodiment illustrated in FIG. 2, the fracturing system 24 comprises six pumps 34 and one missile 32 mounted on a missile trailer 38. The pumps 34 also may be truck and/or trailer mounted pumps. Depending on the application, other numbers of pumps 34, missiles 32, and/or blenders 28 may be employed. The slurry is discharged from missile 32 into high-pressure lines 40, such as two high-pressure lines 40 having a left high-pressure line and a right high-pressure line, as in the example illustrated in FIG. 2. Flow of proppant through the high-pressure lines 40 may be monitored by a downstream densitometer or by a plurality of downstream densitometers 42 prior to delivery of the slurry to wellhead 36. The high-pressure lines 40 connect the missile 32 with wellhead 36.

Figure 3:
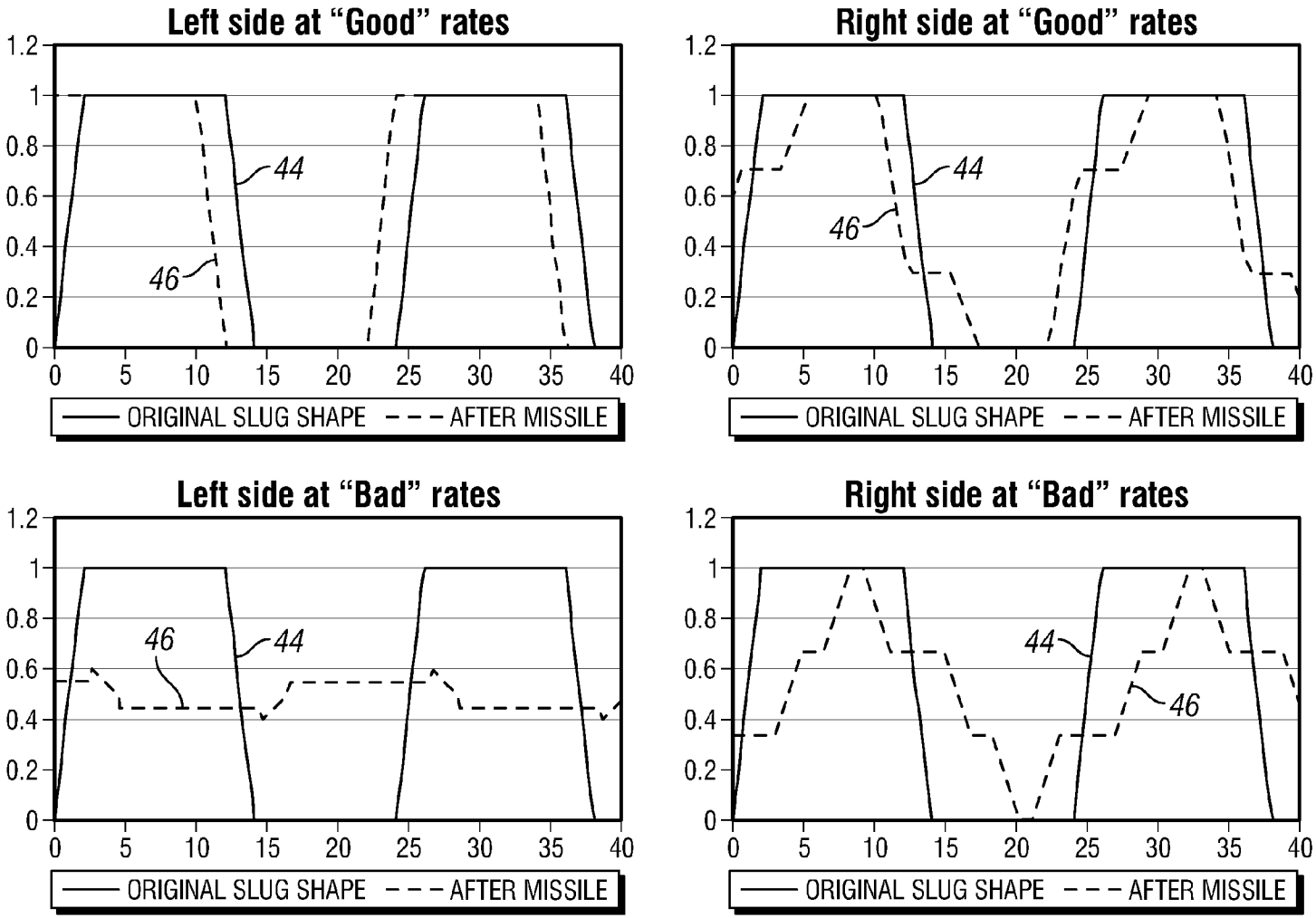
FIG. 3 is a graphical illustration of proppant slurry having pulses of proppant which moves through a plurality of pumps, according to an embodiment of the disclosure.
Figure 4:
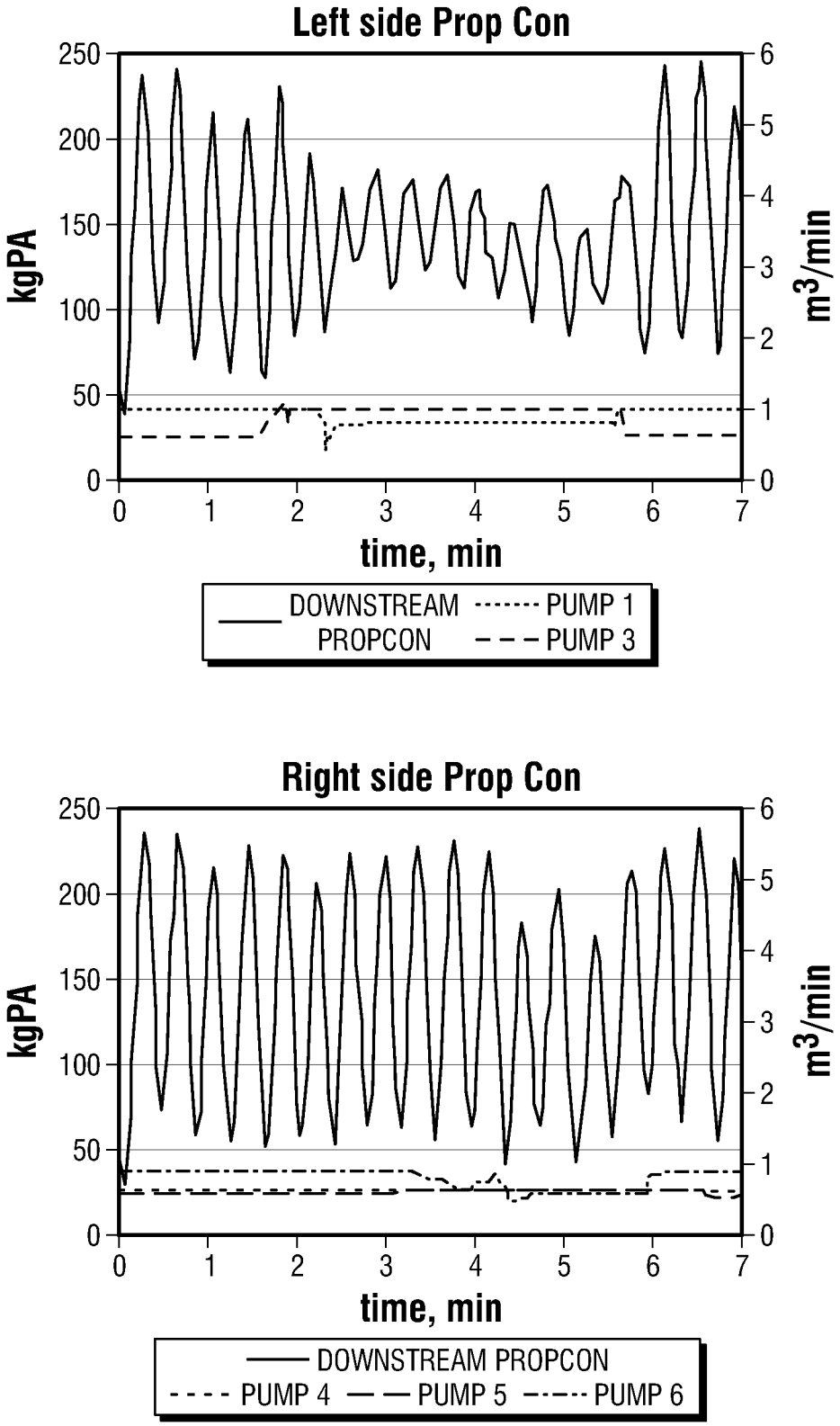
FIG. 4 is a graphical illustration of proppant concentrations measured by densitometers downstream of the pumps, according to an embodiment of the disclosure.

Graphs of FIGS. 3 and 4 illustrate the prevention of dispersion and the maintenance of heterogeneous proppant pulses 22 by both adjustment of the pump rates and by determining a regimen of best practices for maintaining improved heterogeneity even when pump rates are not optimized. In FIG. 3, for example, the proppant concentration of the proppant pulses 22 is illustrated at the entrance to missile 32 by a first graph line 44 and at the exit of missile 32 by a second graph line 46 based on data from densitometers 42. In this example, the pump rates vary between predetermined, optimized rates (see top graphs) and less optimized rates (see bottom graphs). Additionally, the left side and right side of the fracturing system 24 has been represented by the left side graphs in the right side graphs, respectively. The right side of fracturing system 24 has various other system components optimized, as described in greater detail below.

As illustrated by the upper left section of the graph, the proppant pulse shape has been reconstructed at the exit of missile 32 to provide substantially recombined or reconstructed proppant pulses, as represented by graph line 46. However, if the pump rates are not optimized, the heterogeneity of the proppant pulses may be reduced at the exit of missile 32, as represented in the lower left portion of the graph. If other parameters of fracturing system 24 are optimized, however, the amount of dispersion of the proppant pulses 22 may be reduced even if the pump rates change from optimized rates to less than optimized rates, as represented by the transition between the upper right portion of the graph and the lower right portion of the graph. As illustrated for this example, the proppant pulses or slugs on the left side deteriorate more when the pumping rates move from good (e.g. optimized) rates to less optimized rates at least once other system parameters are not optimized. This result is confirmed by the graphs in FIG. 4 which show that the left side slugs/proppant pulses are substantially reduced while the right side slugs/proppant pulses maintain a substantial degree of heterogeneity. Consequently, selecting proper pump rate distribution between the plurality of pumps 34 and evaluation of other system parameters may both be used as tools to facilitate reconstruction of the proppant pulses 22 after passage through pumps 34 and missile 32.

Figure 5:
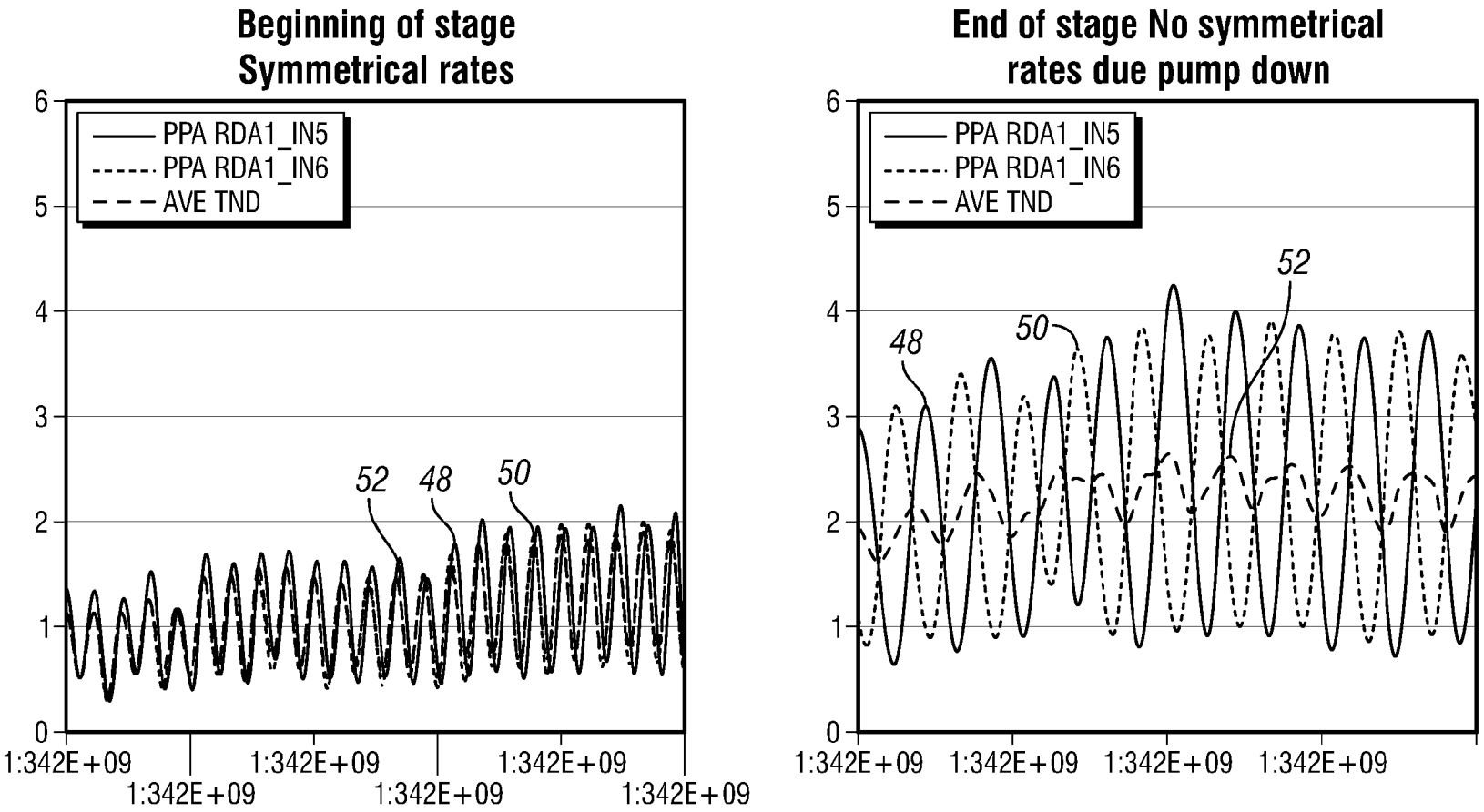
FIG. 5 is a graphical illustration of proppant pulse dispersion prior to pump rate adjustment, according to an embodiment of the disclosure.
Figure 6:
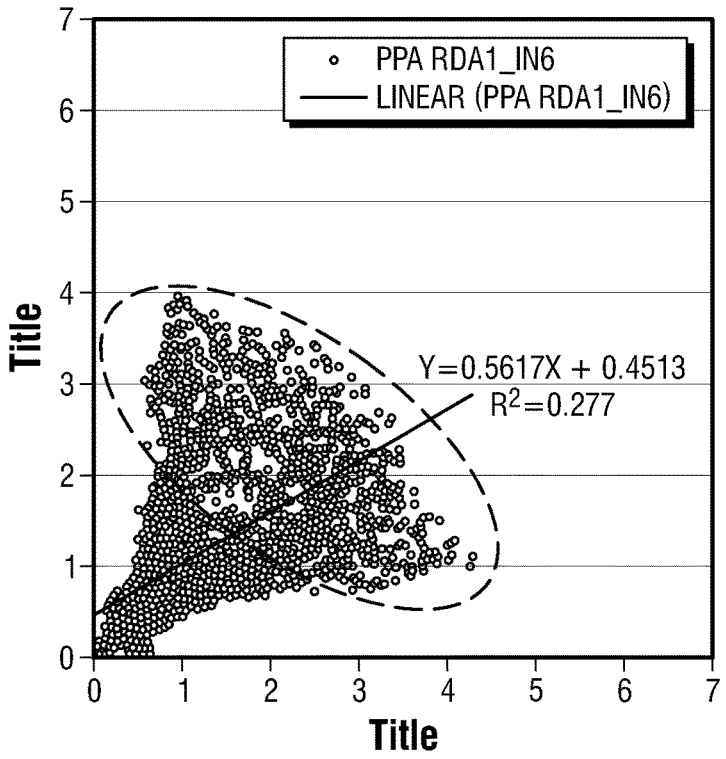
FIG. 6 is a graphical illustration also showing proppant pulse dispersion, according to an embodiment of the disclosure.

If the pump rates of pumps 34 are not adjusted to prevent dispersion, substantial mixing of the proppant and clean fluid can occur, as illustrated graphically in FIGS. 5 and 6. In this example, best practices were not followed and the pump rates were not optimized following changes in the circumstances of the treatment operation. Initially, the pulses or slugs of proppant were heterogeneous and separated by clean fluid having a lower concentration of proppant, as represented by graph lines 48, 50, and 52 on the left side of the graph in FIG. 5. However, by the end of such a fracturing job, the pulses travelling in different flow lines get to the well head desynchronized (see graph lines 48 and 50 on the right side of the graph in FIG. 5). This scenario mixes all of the pulses 22 and results in a substantially homogenous fracturing fluid (see graph line 52). As the surface volume is increased (more lines, pumps, hoses, etc.) the likelihood of this problem increases and it becomes more difficult to control without any adjustment of pump rates and/or without employing best practices in the design of fracturing system 24.

Figure 7:
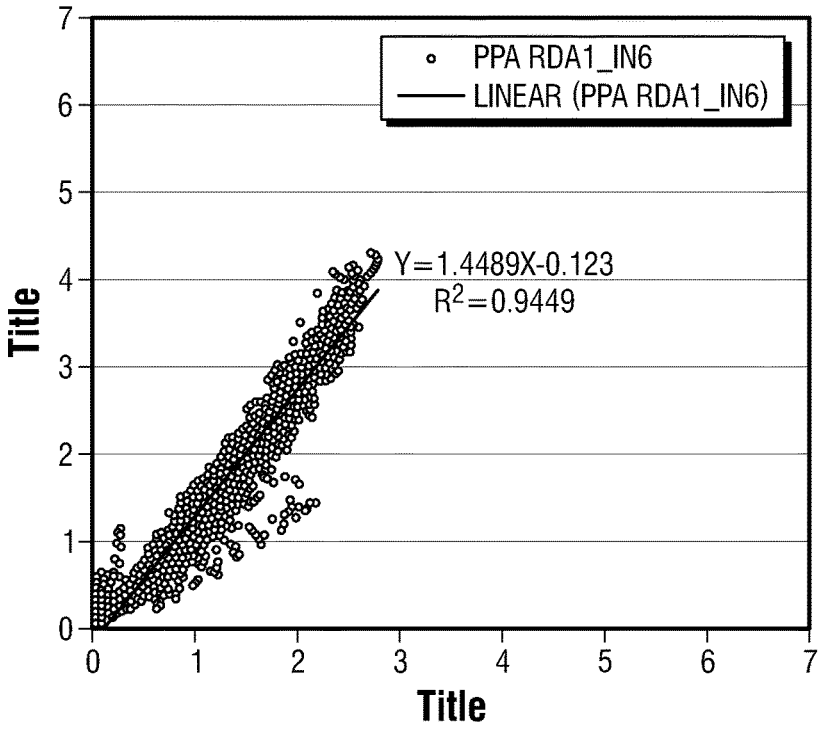
FIG. 7 is a graphical illustration of proppant pulse dispersion when pump rates are individually controlled to maintain heterogeneity of the proppant slurry, according to an embodiment of the disclosure.

FIG. 6 represents a quick graphical method to quantify the dispersion generated by the lack of synchronization. On the x-axis, we plot sand/proppant concentration at some moment of time as recorded by a densitometer 42 installed in one of the discharge lines 40 of the manifold. On the y-axis we plot sand concentration recorded at the same instant at the densitometer 42 installed in the other line 40. In this example $R^2=1.0$ represents the desired synchronization of the pulses and $R^2=0.0$ the worst scenario theoretically possible. For the stage presented in FIGS. 5 and 6, a value of $R^2=0.27$ was obtained. However, FIG. 7 represents another stage where the best practices described herein were used to adjust the pumping rates for optimizing recombination and maintenance of the proppant pulses 22 on the downstream side of missile 32. In this latter example, the synchronization of pulses entering the wellhead 36 was established as $R^2=0.9449$. Embodiments of the present technique for maintaining heterogeneous proppant slurry are designed to enable achievement of $R^2>0.90$ in most of the cases. The pump rate adjustment technique has been tested on several occasions with consistent results. Additionally, the best practices also may include optimizing the overall design and configuration of fracturing system 24 to further help maintain heterogeneity even if the pumping rates are not fully optimized.

Figure 8:
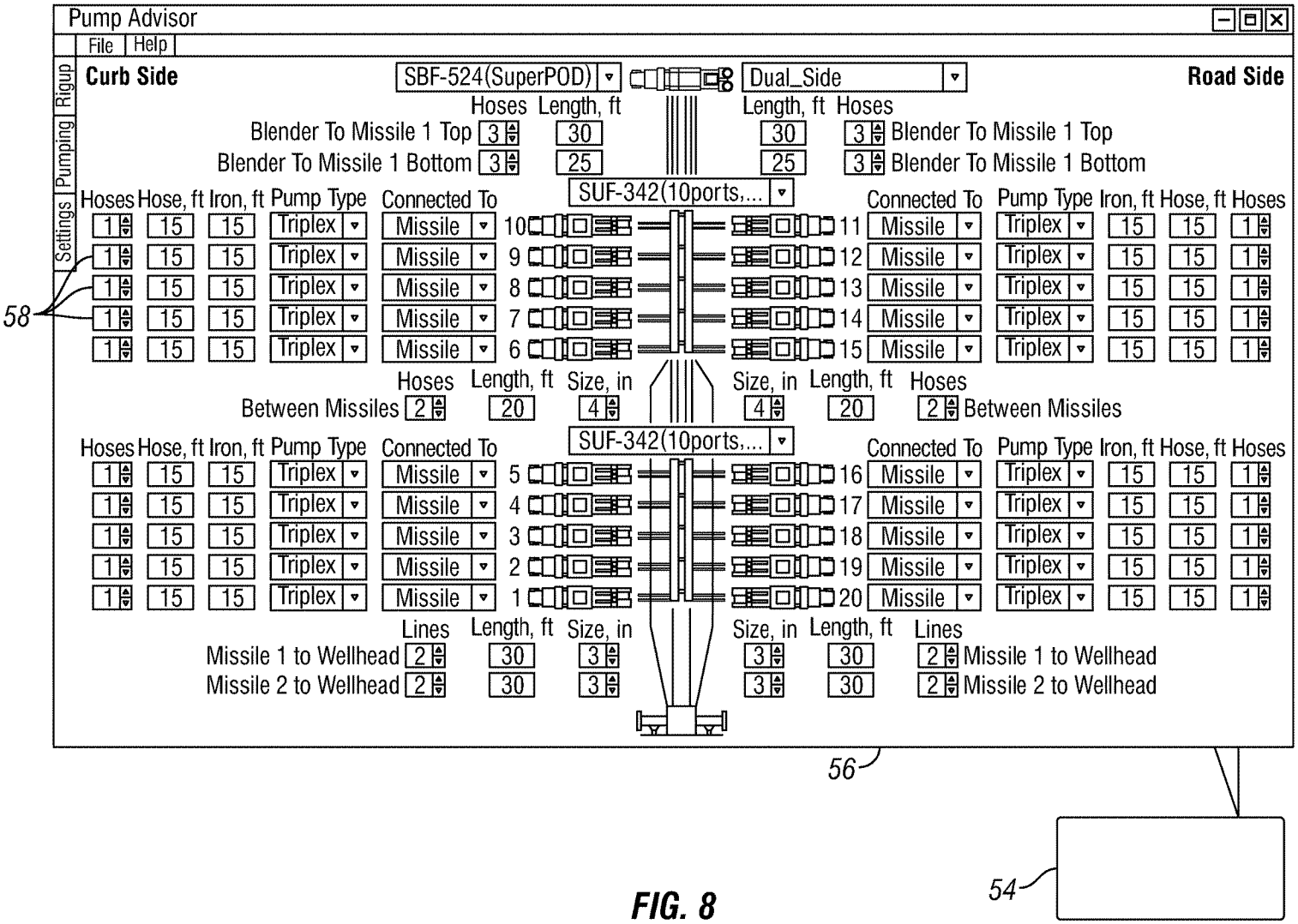
FIG. 8 is an illustration of a graphical user interface which may be used in cooperation with a processor-based control system to adjust fracturing system parameters, according to an embodiment of the disclosure.

The adjustments to pumping rates as well as the enhancement of fracturing system design/configuration may be established with the aid of, for example, a processor-based system 54 having a graphical user interface 56. As illustrated in FIG. 8, graphical user interface 56 may be used to enter a variety of parameters 58 into processor-based system 54 for processing and evaluation of the structure of fracturing system 24. The processor-based system 54 may be used to automatically control or to provide recommendations regarding adjustments and/or changes with respect to system components and operational parameters. By way of example, processor-based system 54 may utilize a C-language computer program to determine best practices for a given fracturing operation. However, a variety of other computer languages, models, algorithms, programs and other features may be employed to facilitate determination of best practices for the specific fracturing operation. Processor-based system 54 also may be programmed to automatically control the pump rates of the individual pumps 34 in response to specific inputs, such as data received from densitometers 42.

Figure 9:
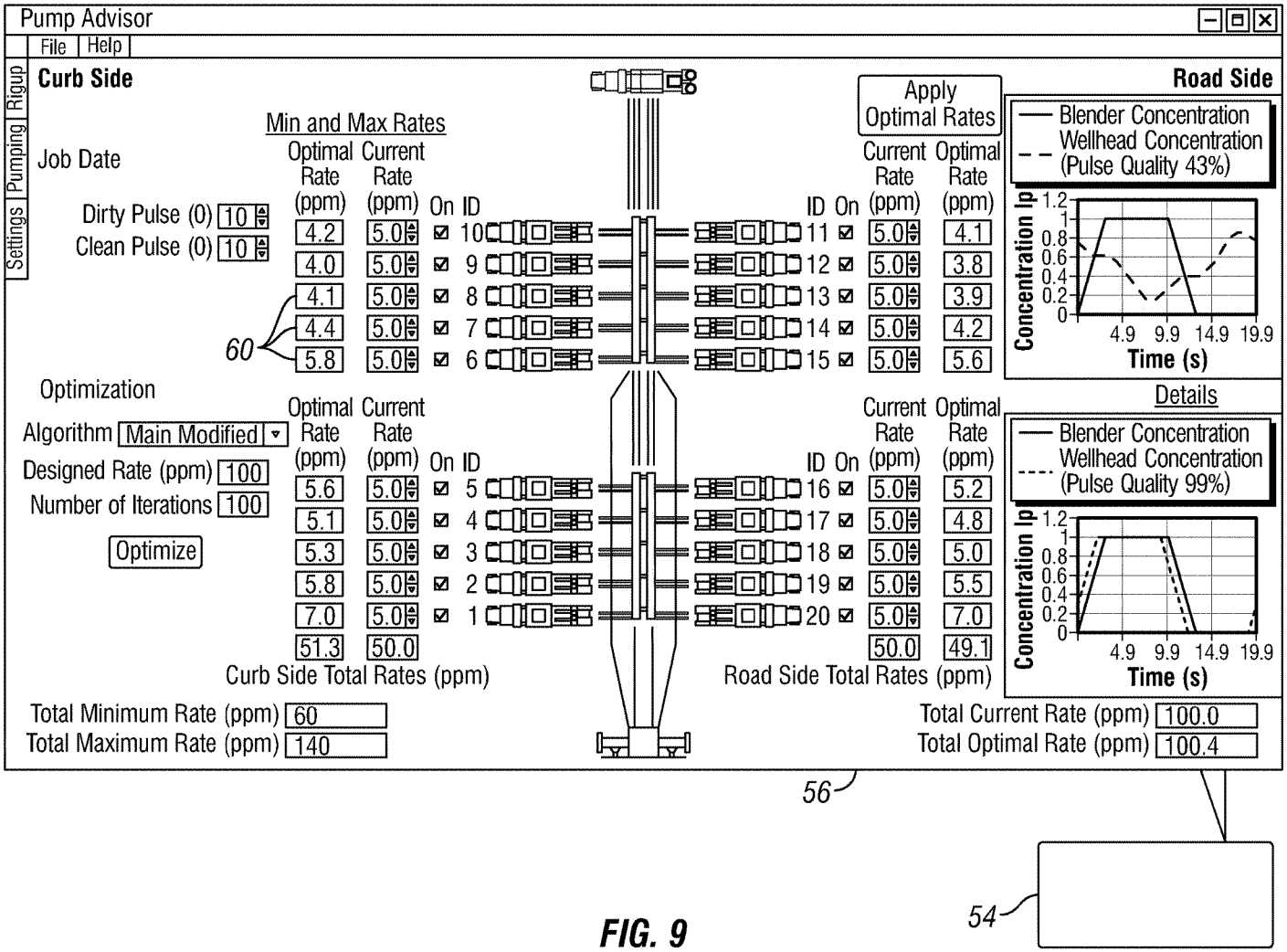
FIG. 9 is another illustration of a graphical user interface which may be used in cooperation with a processor-based control system to adjust pumping rates, according to an embodiment of the disclosure.

The graphical user interface 56 also may be used to input and output a plurality of pumping rates 60, as illustrated in FIG. 9. By way of example, the graphical user interface 56 may allow an operator to input a variety of pump rates, and a processor-based system 54 may be programmed to analyze those rates and to determine improved rates and/or adjustments to the rates on an ongoing basis during performance of the fracturing operation, thus maintaining heterogeneity of the proppant pulses 22 at wellhead 36. The graphical user interface 56 also may be used to output a variety of pump rate information from densitometers 42 and other data related to the fracturing operation.

The specific procedure for facilitating a given fracturing operation may involve a variety of other and/or additional procedural steps. In some applications, the process for facilitating fracturing involves pre-determining a variety of system parameters in addition to adjusting the pumping rates to maintain synchronization of the proppant pulses/slugs before and after moving through missile 32. For example, a procedure may involve initially determining the types of low pressure piping or hoses to be employed in fracturing system 24, including the number, length, and/or placement of those pipes and hoses. Similarly, the procedure may comprise determining the number, length and/or placement of the high pressure piping, e.g. high-pressure lines 40.

Additionally, the procedure for reducing dispersion of proppant material may comprise determining the number of pumps 34 and the type of pumps, e.g. triplex fluid end or quintiplex fluid end pumps. Similarly, the type of blender or blenders 28 may be determined along with the number and type of missiles 32. The processor-based system 54 also may be employed to help specify a configuration for rigging up the pumps 34, missiles 32, and blenders 28. In some applications, a determination is made as to whether the pumps 34 are restricted with respect to maximum pump rate or minimum pump rate. Additionally, an overall pumping rate for the fracturing job is determined. The processor-based system 54 or another suitable system may then be employed to process the various system parameters and pump parameters to determine an initial, desired pump rate for each of the pumps 34.

By way of example, the processor-based system 54 may be programmed to perform an iterative process for determining the amount of time it takes a particle to leave the blender 28, travel through the low-pressure side, through the specific pump 34, and then flow to the wellhead 36. This calculation is performed for each pump 34 given the length of the low-pressure piping/hoses, the length of the high-pressure lines 40, and the given pump rate for that specific pump 34. The pump rate for each pump 34 may then be adjusted so that the time it takes for the particle to travel to the wellhead 36 is the same for each of the pumps 34. In other applications, the processor-based system 54 may be programmed to adjust the pump rate based on predetermined equations. For example, processor-based system 54 may have multiple sets of flow equations that can be used for each of the pumps 34 and those equations can be solved given the restrictions on minimum rate and maximum rate for each pump 34. The solutions may be used to adjust the pump rates for each pump 34 to achieve pump rates which match or substantially match the pump rates recommended by the solutions to the equations.

In this example, the densitometers 42 may be used to ensure that the proppant concentrations are adequately heterogeneous. In other words, the densitometers 42 may be used to ensure the proppant concentrations moving into missile 32 substantially match the proppant concentrations at wellhead 36. Such matching indicates that proppant pulse 22 integrity has been maintained.

As described herein, the fracturing system 24 may comprise a variety of pumps 34 and other system components depending on the specifics of a given fracturing operation. The design of those components and the overall configuration of the fracturing system 24 may affect the maintenance of fracturing fluid heterogeneity. In many applications, the proppant pulses and thus the heterogeneity of the fracturing fluid may be maintained or improved by adjusting the pump rates. However, additional improvements may be provided by adjusting components and arrangements of components in the overall fracturing system 24. The adjustments to pumping rates may be calculated according to a variety of manual and automated methods. For example, a processor-based system 54 may be used for processing data according to desired programming and/or equations so as to balance the pump rates of a plurality of pumps 34 in a manner which maintains the proppant pulses at the wellhead, thus facilitating the fracturing operation.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A method for facilitating a fracturing operation, comprising:

delivering proppant from a blender in a pulsating manner to create pulses of proppant;

mixing the proppant with a fluid to create a slurry having the pulses of proppant separated by a second fluid having a lower concentration of proppant thereby providing a repeating heterogeneous concentration of proppant into a manifold comprising at least one missile;

splitting the slurry among a plurality of pumps forming portions of proppant pulses exiting the manifold;

monitoring the portions of proppant pulses with at least one densitometer between the plurality of pumps and a wellhead; and using a processor-based system to adjust pump rates of the plurality of pumps individually to control dispersion of the portions of proppant pulses downstream of the pumps whereby the portions of proppant pulses from the plurality of pumps form a single mixture substantially maintaining the repeating heterogeneous concentration of proppant within the single mixture to a wellhead, wherein a synchronization of the proppant pulses $R^2$ is higher than 0.90.

2. The method as recited in claim 1, wherein adjusting comprises adjusting pump rates to minimize dispersion of the pulses of proppant in the slurry.

3. The method as recited in claim 1, wherein adjusting comprises utilizing a processor-based system to perform an iterative process to determine particle travel time through each pump.

4. The method as recited in claim 1, wherein adjusting comprises utilizing a processor-based system to process equations used to estimate flow through each of the pumps.

5. The method as recited in claim 1, further comprising adjusting parameters of additional equipment to facilitate delivery of pulses of proppant into the well.

6. A method for facilitating a fracturing operation, comprising:

assembling a fracturing system with a blender, a plurality of pumps, and a manifold comprising at least one missile at a well site according to a predetermined design;

operating the blender to deliver a proppant in pulses of proppant to provide a repeating heterogeneous concentration of proppant with a slurry into the manifold;

delivering the pulses of proppant through the at least one missile to the plurality of pumps via a second fluid;

using a plurality of densitometers between the plurality of pumps and a wellhead to monitor the pulses of proppant; and using a processor-based system to manipulate operation of the plurality of pumps to prevent homogeneous mixing of the pulses of proppant with the second fluid as the pulses of proppant and the second fluid are delivered through the at least one missile to form a single mixture to a wellhead, wherein the repeating heterogeneous concentration of proppant after passing through the at least one missile and the plurality of pumps is substantially maintained by the single mixture at the wellhead, wherein a synchronization of the proppant pulses $R^2$ is higher than 0.90.

7. The method as recited in claim 6, further comprising combining the proppant in the second fluid at the blender.

8. The method as recited in claim 6, wherein manipulating comprises controlling the pumps with a processor-based controller.

9. The method of claim 1, wherein the at least one densitometer ensures that the proppant concentration of the slurry into the manifold comprising the at least one missile concentration of proppant into the manifold comprising the at least one missile substantially matches the concentration of proppant within the single mixture to the wellhead.

* * * * *